United States Patent [19]

Walston

[11] Patent Number: 4,512,126

[45] Date of Patent: Apr. 23, 1985

[54] PANEL MODULE MEANS

[75] Inventor: Everett V. Walston, Indianapolis, Ind.

[73] Assignee: Beaver Products, Inc., Noblesville, Ind.

[21] Appl. No.: 334,530

[22] Filed: Dec. 28, 1981

[51] Int. Cl.[3] ..... E04B 1/04

[52] U.S. Cl. ..... 52/251; 52/309.12; 52/405

[58] Field of Search ..... 52/251, 405, 309.17, 52/309.12, 311, 313, 285, 91, 250, 259, 167

[56] References Cited

U.S. PATENT DOCUMENTS

| | | | |
|---|---|---|---|
| 2,592,634 | 4/1952 | Wilson | 52/405 X |
| 3,372,519 | 3/1968 | Russell | 52/285 X |
| 3,415,023 | 12/1968 | Lebreton | 52/405 |
| 3,462,897 | 8/1969 | Weinrott | 52/285 X |
| 3,775,240 | 11/1973 | Harvey | 52/285 X |
| 4,015,387 | 4/1977 | Tillie | 52/309.17 |
| 4,291,513 | 9/1981 | Ankarswed | 52/405 X |

FOREIGN PATENT DOCUMENTS

| | | | |
|---|---|---|---|
| 510456 | 3/1955 | Canada | 52/285 |
| 532745 | 11/1956 | Canada | 52/285 |

*Primary Examiner*—J. Karl Bell

*Attorney, Agent, or Firm*—Robert A. Spray

[57] ABSTRACT

A composite panel module formed of concrete and insulation block, providing the endurance, fire-protection, etc., of those materials in contrast to wood, yet avoiding disadvantages of other ceramic facing or panel materials such as brick or blocks; and the invention further provides and formation process by which such panels are formed into integral modules, for erection of a building by pre-fabrication procedures.

5 Claims, 40 Drawing Figures

PANEL MODULE MEANS

The present invention relates to panels, such as for sidings of a building construction, and to a process for the forming thereof; and, more particularly, relates to panel modules formed of concrete and insulation blocks into modules of various kinds for use in providing whatever siding features are desired for the building.

By the present inventive concepts, the exterior face of the panel modules is provided to be of concrete, and nevertheless to have formed thereinto an attractive wood-grained appearance and texture of wood siding, yet rearward portions of the panel modules are formed of insulation blocks, in integrated panel modules which may be easily installed.

The inventive concepts also provide an advantageous panel-formation procedure and method, a process by which the panel modules may be readily and conveniently formed into any of the variety of module forms, using mass production techniques for quality and consistency, and for economy of materials and labor, reduction of scrap, and other advantages of pre-fabrication and mass production techniques.

The concepts also provide several particular and advantageous features, such as (a) integrally carried insulation of high insulating nature, thus making the building quite energy-efficient without the expense of a separate insulation-installation procedure; (b) a reinforcing grid of steel rod stock formed integrally into the concrete; (c) integrally-carried connector members for firm and easy connection of the panel modules to a floor slab or to floor joists, and to ceiling and/or roof components; (d) stiffening ribs or flanges of concrete which integrally provide high strength by increased moment of inertia along the panel yet keep down the overall weight of each of the panel modules; (e) wooden nailer blocks, pre-mounted into the panel modules for the convenient mount of furring strips for holding dry wall; (f) the feature of sandblasting to enhance the wood-grain pattern or design; (g) the vibration of the concrete being poured; and (h) the wetting of the mold; and such features provide advantages of the procedure and of the panel modules, and provide ease and economy of assembly of the panel modules and the buildings components connected thereto.

When prepared in the manner herein set forth, and formed to provide the integrated panel module components as herein set forth, high advantages are achieved, of fire-retarding and maintenance-free concrete, with speed of erection by pre-fabrication concepts, ease of painting and/or sealing, economy of construction, very high insulation quality, etc. The outside panel modules may be set directly upon the building's footings; and once set in place, the entire building exterior can be erected quite quickly. The accessories such as windows and doors are conveniently pre-fabricated into the individual panel modules, adding to the economy and rapidity of assembly.

The above description is of an introductory and thus of somewhat generalized nature; more particular features, details, and concepts are set forth in the following and more detailed description, reference being had to the accompanying somewhat diagramatic drawings of the panel modules, their use and their process of formation. In such drawings.

Figure 1:
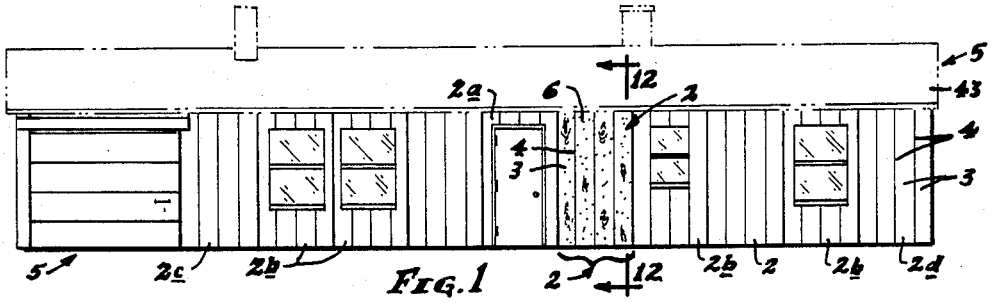
FIG. 1 is an elevation view of a building whose exterior wall is formed of concrete composite panels according to the present invention, although the wood-grain design is shown as formed in only one of the several panels of the wall.
Figure 2:
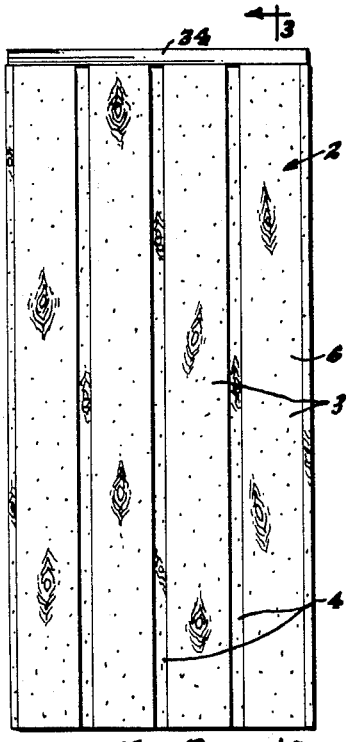
FIG. 2 is an elevation view, in enlarged scale, of the outer face of a concrete composite panel module of the present invention, it being shown in its steps of formation by the sequential process step views of FIGS. 27–40.
Figure 3:
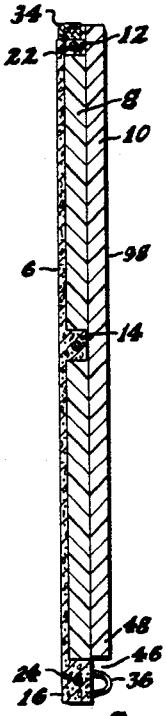
FIG. 3 is a vertical cross-sectional view of the panel shown in FIG. 2, shown generally as taken by Section-line 3—3 of FIG. 2.
Figure 4:
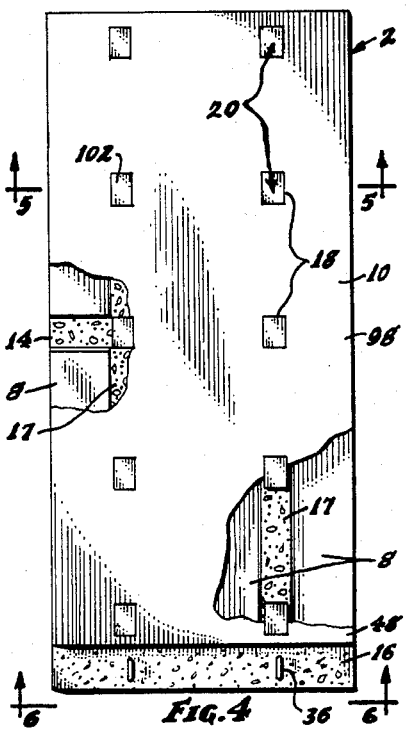
FIG. 4 is an elevation view, similar to FIG. 2, of a panel of this invention but showing its interior face, as per FIG. 40, certain portions shown as broken away to illustrate details interior of the composite panel.
Figure 5:
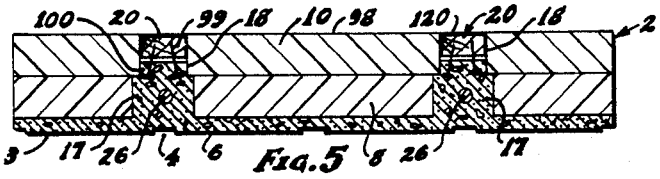
Figure 6:
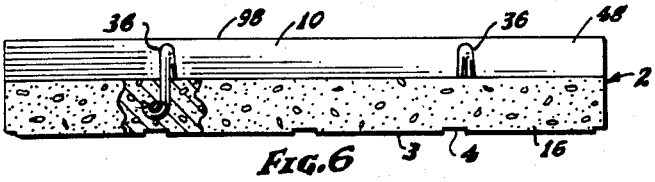
Figure 7:
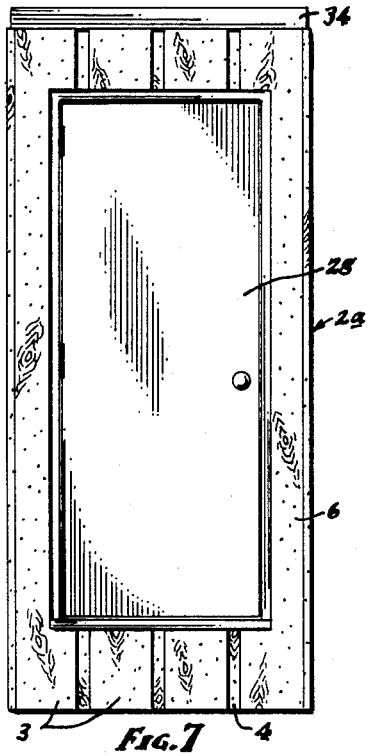
Figure 8:
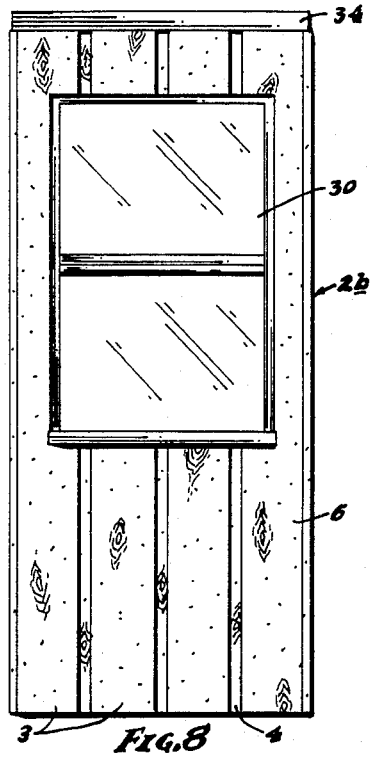
Figure 9:
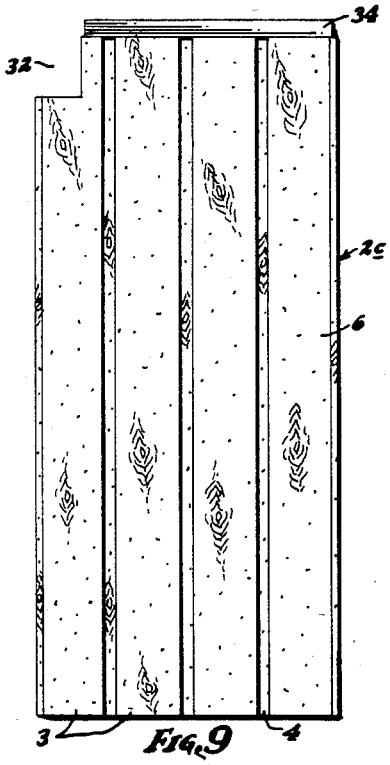
Figure 10:
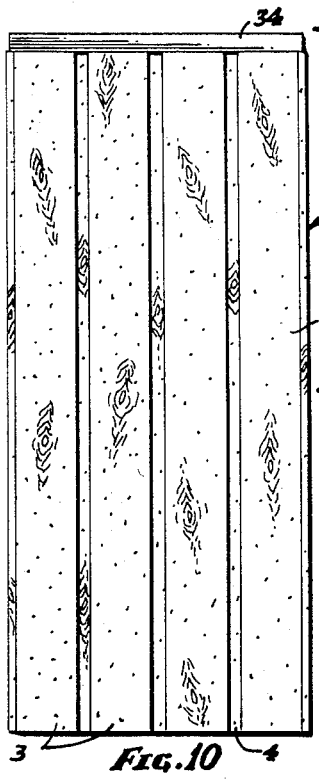
Figure 11:
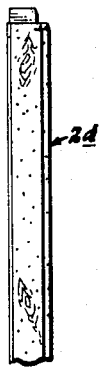
Figure 12:
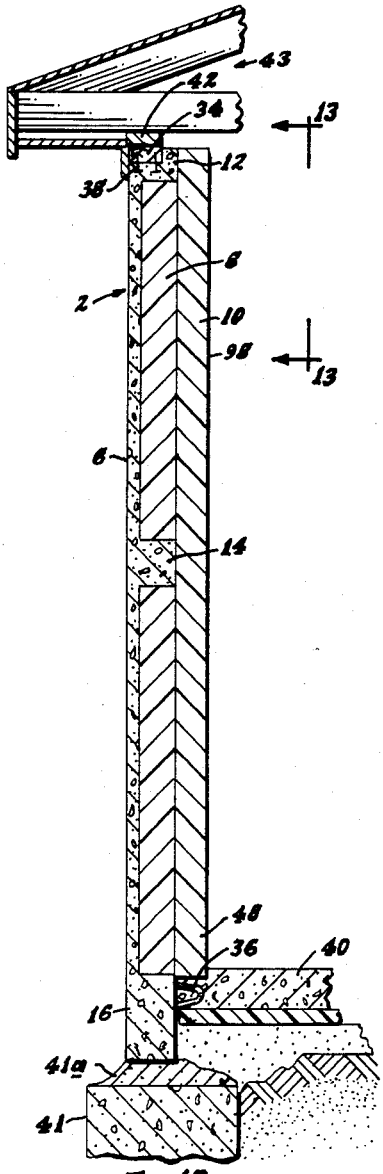
Figure 13:
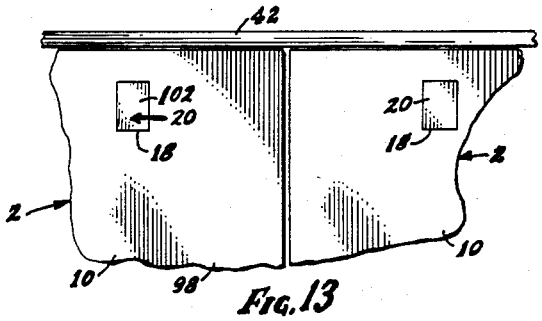
Figure 14:
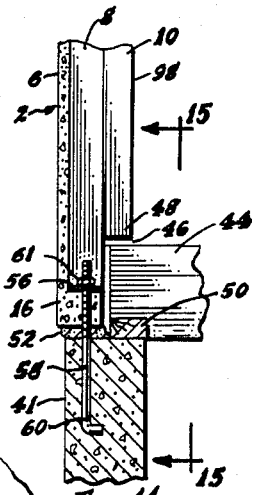
Figure 15:
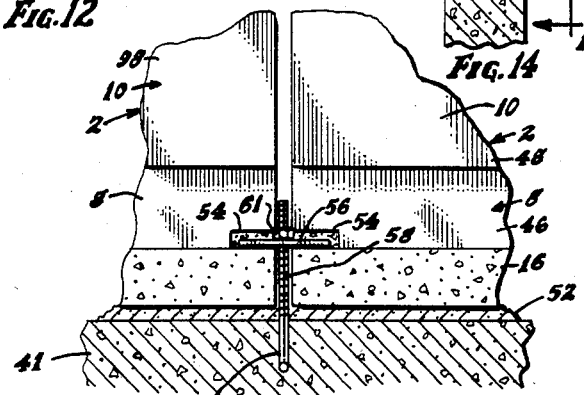
Figure 16:
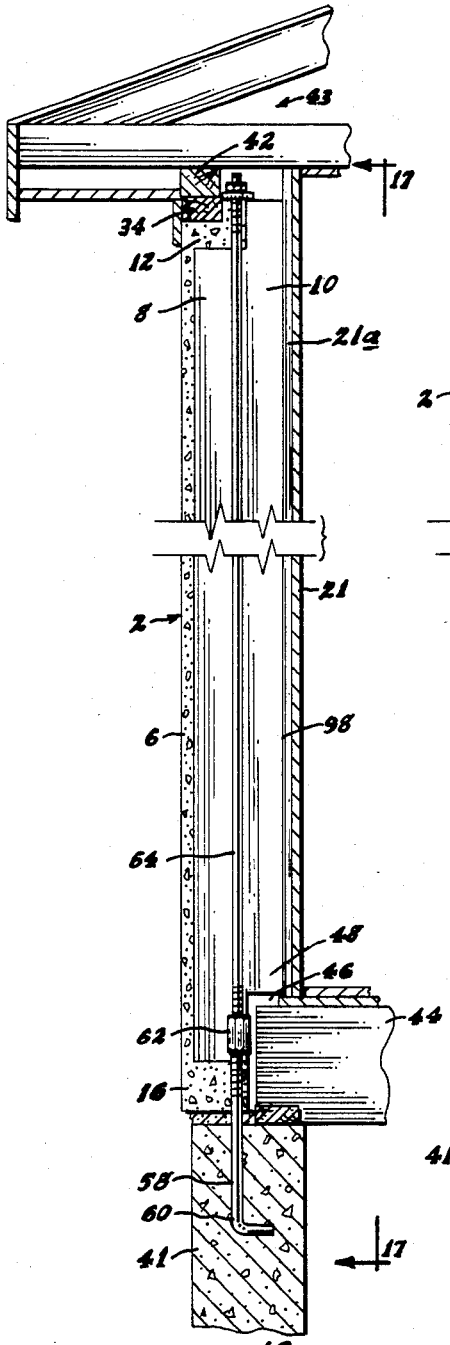
Figure 17:
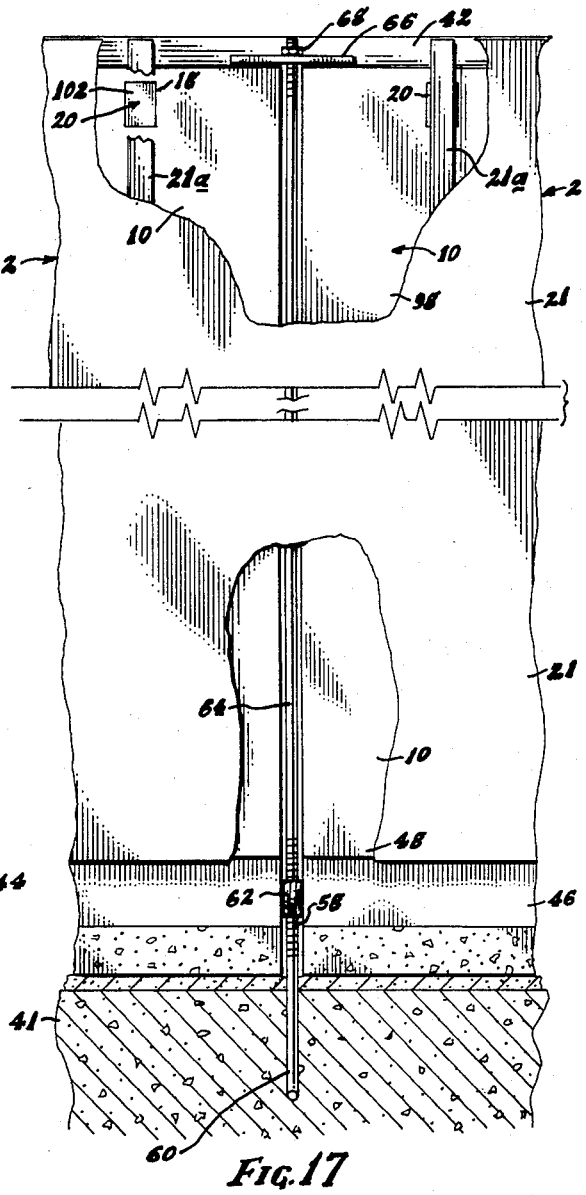
Figure 18:
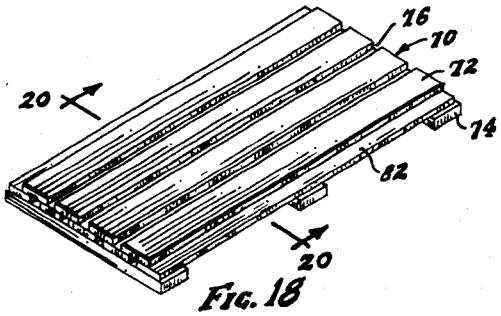
Figure 19:
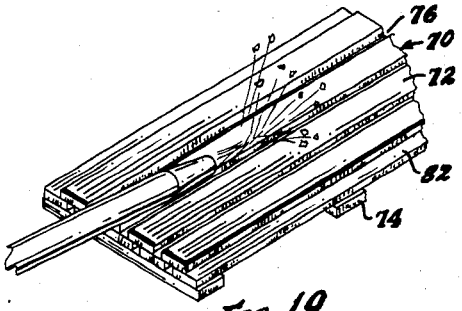
Figure 20:
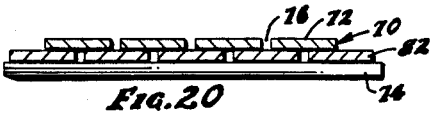
Figure 21:
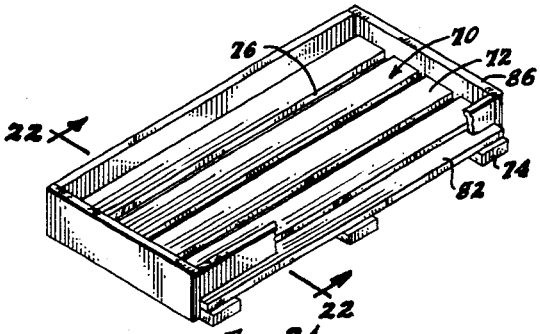
Figure 23:
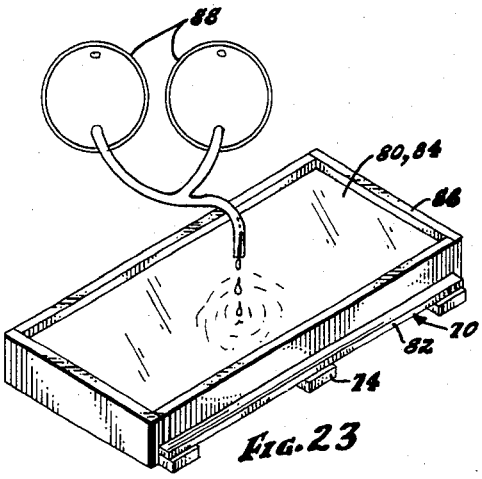
Figure 22:
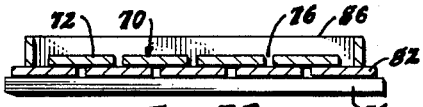
Figure 25:
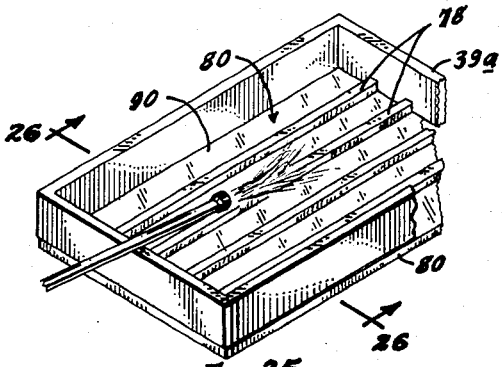
Figure 24:
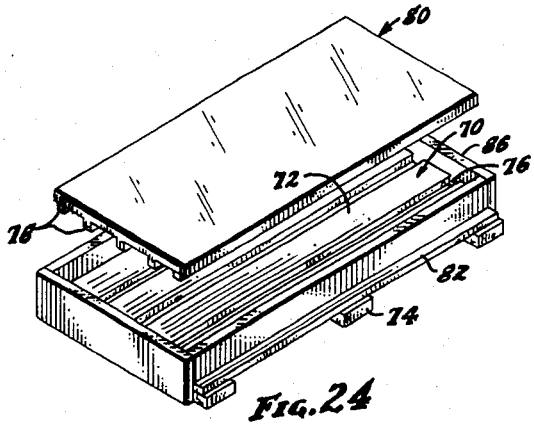
Figure 26:
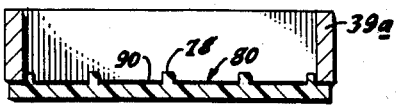
Figure 27:
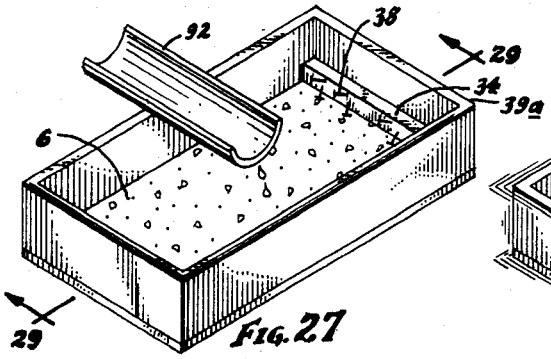
Figure 28:
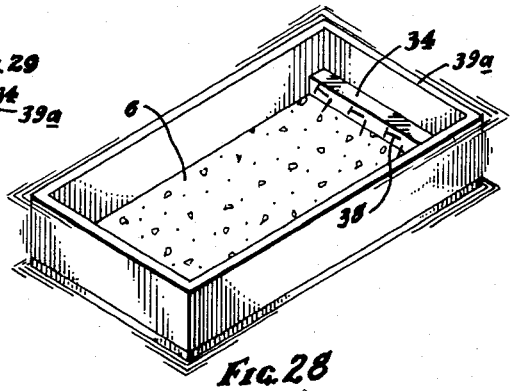
Figure 29:
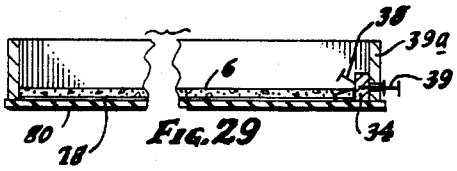
Figure 31:
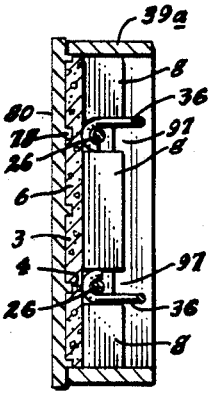
Figure 30:
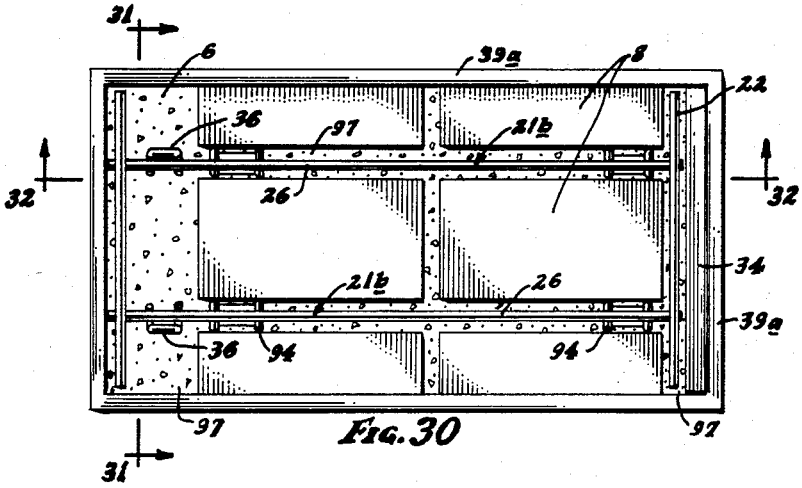
Figure 33:
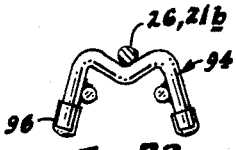
Figure 32:
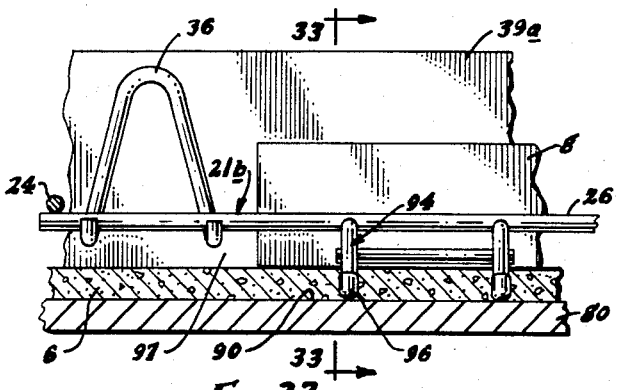
Figure 34:
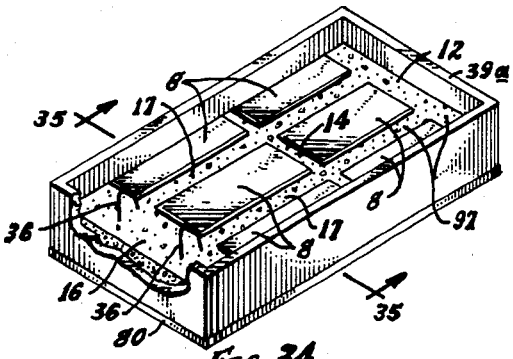
Figure 36:
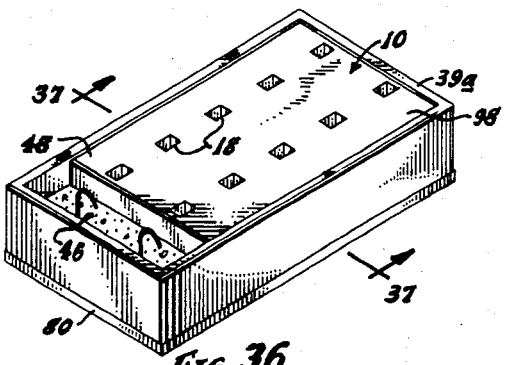
Figure 35:
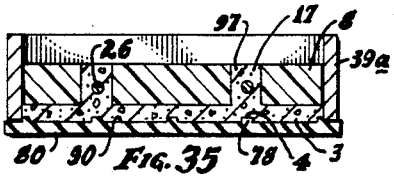
Figure 37:
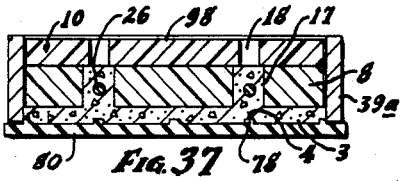
Figure 39:
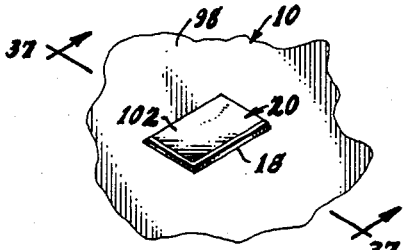
Figure 38:
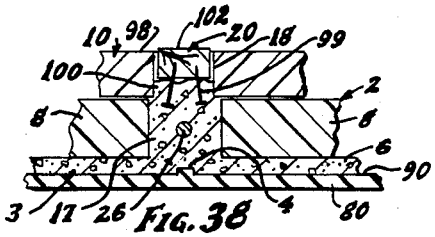
Figure 40:
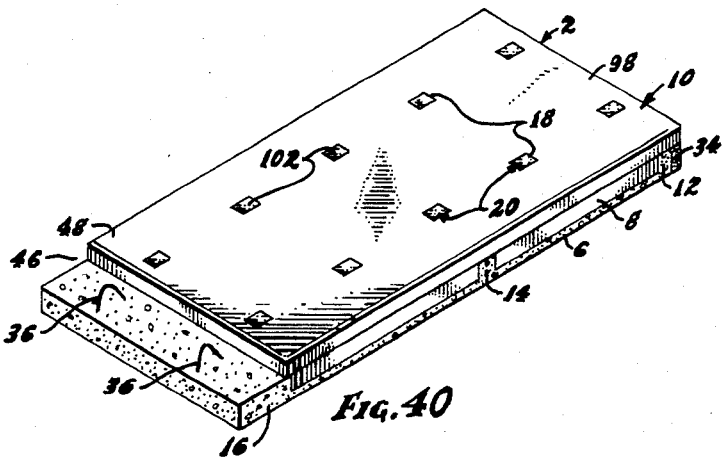

FIG. 5, in further enlarged scale, is a transverse cross-sectional view of the panel of FIGS. 2–4, as shown generally as taken by Section-line 5—5 of FIG. 4, and shown in the sequential process-step view of FIG. 38;

FIG. 6 is a transverse cross-sectional view, similar to FIG. 5, but of the bottom of the panel, shown generally as taken by View-line 6—6 of FIG. 4;

FIG. 7 is an elevation view of the composite panel similar to the view shown as FIG. 2, but of a type in which a door is cast thereinto;

FIG. 8 is an elevation view of a similar composite panel, but having a window cast thereinto;

FIG. 9 an elevation view of a panel generally similar to that of FIG. 2, but of a form having a notch formed into an upper corner thereof for use of accommodating and supporting a support lintel such as used in an overhead garage door installation;

FIG. 10 is an elevation view of a panel generally similar to that of FIG. 2, but for use as an end panel of a wall, with wood grain design having been formed into the edge thereof which is exposed in use, as an outside corner of the building;

FIG. 11 is a fragmental elevation view of the edge of the end panel of FIG. 10 which has the design formed thereinto, the view being that generally as indicated by View-line 11—11 of FIG. 10;

FIG. 12 is a vertical cross-sectional view, shown generally as taken by Section-line 12—12 of FIG. 1 but in enlarged scale, the panel being shown generally as in FIG. 3 but showing fragmental details of associated components of the building into which the panel is shown as installed, this being an embodiment in which the floor is a slab of concrete;

FIG. 13 is a fragmental elevation view of a portion of the interior face of an adjacent pair of the panels shown in FIG. 12, the view being that as indicated by View-line 13—13 of FIG. 12;

FIG. 14 is a fragmental elevation view of the lower portion of a panel, and associated building components, as shown in FIG. 15, of an embodiment in which the building floor is not a slab such as in FIG. 12 but instead is of a type having a horizontal floor joist, such as a type as used in a building having a basement or crawl space;

FIG. 15 is a fragmental view of the interior face of an adjacent pair of panels, and associated building components, of the embodiment shown in FIG. 14, shown generally as taken by Section-line 15—15 of FIG. 14, but in enlarged scale, the blocks shown in FIG. 30 as added having been notched to accommodate a bearing plate of the support rod which extends upwardly from the wall on which the panels are supported;

FIG. 16 is a vertical cross-sectional view of a panel and associated building components of an extra-strength embodiment for buildings in tornado or earthquake areas;

FIG. 17 is an elevation view of building components of FIG. 16, broken away to show the interior face of an adjacent pair of panels of this invention, and associated mounting strips, this embodiment being the extra-strength embodiment shown in FIG. 16, the view being shown generally as taken by View-line 17—17 of FIG. 16;

FIG. 18 is a pictorial view of a wooden form assembly to be used as a mold for forming the composite panels of this invention, the form made of spaced slats of grainy wood;

FIG. 19 is a view of the form shown in FIG. 18 but illustrating a sandblasting step used for enhancing the wood-grain pattern;

FIG. 20 is a cross-sectional view of the form shown in FIGS. 18 and 19, shown generally as taken by Section-line 20—20 of FIG. 18;

FIG. 21 is a pictorial view of the form shown in FIG. 18, but with a border-frame applied thereto, portions shown as broken away;

FIG. 22 is a cross-sectional view of the form and border-frame shown in FIG. 21, shown generally as taken by Section-line 22—22 of FIG. 21;

FIG. 23 is a pictorial view illustrating the step of pouring a two-part rubber mixture into the form assembly shown in FIGS. 21 and 22, the underside of the rubber form being made having imparted to it the woodgrain design as indicated in FIG. 25;

FIG. 24 is a pictorial view showing the step of removal of the rubber form from the form assembly of FIGS. 21–23;

FIG. 25 is a pictorial view of the step of placing a border frame onto the rubber mold of FIG. 24, the rubber mold having been inverted, and its wood-grain design thus being on the upper-face thereof, and the step of flushing with water to wet the rubber mold surface to minimize air bubbles on the face of the concrete panel to be made, portions shown as being broken away;

FIG. 26 is a cross-sectional view of the assembly of mold and border frame shown in FIG. 25, shown generally as taken by Section-line 26—26 of FIG. 25;

FIG. 27 is a pictorial view of the step of having installed a header along an edge of the assembly shown in FIGS. 25 and 26, and with a layer of concrete having been poured thereinto, the view being such that the portion shown as on the upper right, that is, the portion with the header, will be the upper portion when the panel is removed and installed into a building;

FIG. 28 is a pictorial view of the assembly shown in FIG. 27, but in a step of vibrating of the assembly, the view being in the same orientation as FIG. 27;

FIG. 29 is a cross-sectional view of the assembly shown in FIGS. 27 and 28, shown generally as taken by Section-line 29—29 of FIG. 27;

FIG. 30 is a plan view of the assembly shown in FIGS. 27–29, but illustrating the step of having placed polystyrene blocks, reinforcement bar supports, grid of reinforcement bars, and anchor loops thereinto, the view being such that the left portion thereof is the portion which will be the lower portion when the panel is removed and installed into a building, and this is the step in which those blocks may be provided with a notch or notches as shown in FIG. 15, such by cutting the notch(es) at this step and filling the space with a plug which is removable so that it will block concrete from flowing into the space in the step shown in FIG. 34 but is removable to achieve then the void as recess as shown in FIG. 15;

FIG. 31 is a cross-sectional view of the assembly shown in FIG. 30, shown generally as taken by Section-line 31—31 of FIG. 30;

FIG. 32, in enlarged scale, is a fragmental cross-sectional view of the assembly shown in FIG. 30, shown generally as taken by Section-line 32—32 of FIG. 30;

FIG. 33 is a cross-sectional view of the reinforcing bar and a reinforcing bar support shown in FIGS. 30–32, shown generally as taken by Section-line 33—33 of FIG. 32;

FIG. 34 is a pictorial view, portions broken away, showing the assembly shown in FIGS. 30–32, but with the step of having poured several inches more of concrete onto the concrete layer of FIGS. 27–32, generally to the level of the upper face of the polystyrene blocks of FIGS. 30–32, forming concrete ribs and flanges integral with the concrete face layer of FIGS. 27–32, this view being such that the portion shown as on the lower left is the portion which will be the lower portion when the panel is removed and installed into a building;

FIG. 35 is a cross-sectional view of the assembly shown in FIG. 34, shown generally as taken by Section-line 35—35 of FIG. 34;

FIG. 36 is a pictorial view of the assembly shown in FIGS. 34 and 35, in the same orientation as FIG. 34, but with the step of having added a large overlying polystyrene slab or block onto the upper surface of the concrete and polystyrene blocks shown in FIGS. 34 and 35, the overlying or added slab or block being as large as the entirety of the composite panel being formed except that it extends toward the lower (in use) portion of the panel only as far as the blocks of FIGS. 30–34, and it does not extend over the portion (lower left) which has the anchor loops upstanding; although in the embodiments shown in FIGS. 14–17, the overlying panel is even shorter, for accommodating the associated floor joists;

FIG. 37 is a cross-sectional view of the assembly shown in FIG. 36, shown generally as taken by Section-line 37—37 of FIG. 36;

FIG. 38 is a fragmental cross-sectional view, in enlarged scale, of a portion of the assembly shown in FIGS. 36–40, but showing the step of having poured some concrete into the several openings of the overlying slab or block, and with small nailer blocks of wood having been cast into those openings for the convenient mounting of furring strips for the drywall or other interior panelling, with the outer face of the small wood blocks substantially flush with the outer face of the overlying slab or block, the outer face of the overlying slab being the interior face of the composite panel when installed into a building;

FIG. 39 is a fragmental pictorial view of the outer face of the overlying slab in a region thereof containing one of the small nailer blocks of wood; and FIG. 40 is a pictorial view of the composite panel formed as shown sequentially in FIGS. 18–39, after the composite panel has been removed from the mold's border frame shown first in FIG. 25, the face shown as upper in this view being the face of the composite panel which is the interiorly-facing one when the panel is assembled into a building, and the lower left portion of the panel in this view being the lower portion of the panel in its use in a building wall.

As shown in the drawings, a basic feature of the present invention is the provision of concrete composite panels 2 having a design molded thereinto such as the wood grain design schematically represented in FIGS. 1, 2, and 7–11, with what appears to be vertical boards 3 accentuated by intervening vertical grooves 4.

When used in a building 5, such as in the exterior wall thereof as indicated in FIG. 1, the modules 2 provide the appearance wood-siding on the building, yet provide the special advantages of molded concrete siding with high insulation properties.

The panels 2 (FIGS. 3 and 4) are of composite form, having an outer face 6 of concrete, and outer layer 8 and inner layer 10 of an insulation shown as polystyrene blocks. The concrete layer or face 6 has stiffening ribs, integrally extending therefrom and on the rear face thereof, shown as a top flange 12, a central flange 14, a lower flange 16, and vertical flanges 17. The blocks 8 are spaced (e.g. FIGS. 30, 34), the spacing accommodating those flanges and a re-inforcing grid detailed below.

The rearmost layer of insulation block 10 (FIGS. 4, 12–17, and 36–40) is provided with openings 18 into which are fitted blocks 20 of wood, providing a pattern of nailable regions for supporting dry-wall panels 21 (FIGS. 16 and 17), more particularly, the furring strips 21*a* upon which are fastened the dry wall panels 21.

The concrete ribs or flanges (12, 14, 16, 17) are strengthened by a grid 21*b* of reinforcing bars (e.g., FIGS. 3, 5, 30) having horizontal bars at least in the top flange (bar 22) and in the bottom flange (bar 24), and bars 26 in the vertical flanges 17. These and other details are specified in further detail herein, showing preferred construction steps.

The concrete panels 2 may be formed with whatever access or other openings are desired, such as a pedestrian's access door 28 (FIG. 7), a window 30 (FIG. 8), and a form having a notch 32 formed into an upper corner thereof for use of accommodating and supporting a support lintel such as used in an overhead garage door installation (FIG. 9). Also, panels 2 for use as an end of the wall are provided (FIG. 11) with a design, thus providing that such a panel may be used as that which provides an "outside corner" of the building.

(The use of these various forms is illustrated in FIG. 1, by panels all bearing reference number 2 but respectively having suffixes "a", "b", "c", and "d"; although the illustrative wood-grain design is shown as formed into only one panel, by convention of drafting technique.)

Supports are advantageously formed into the panels, such as an upper horizontal header 34 from 2×4 wood stock, and a hook 36 extending rearwardly from the lower concrete flange 16. The header 34 is shown (FIGS. 12, 27–29) as attached to rib 12 by nails 38, whose heads are left away from the header 34 and are held by the material of the concrete rib 12 when it sets up, the header 34 having been laid into an assembly form in a preliminary forming step shown in FIGS. 27, 28, and 29, and held by double-head nails 39 in the construction form 39*a* for ease of removal after formation.

In use, as in an embodiment (FIG. 12) in which the floor is a slab 40 of concrete, the lower support hook 36 is shown as embedded into the floor slab 40; and the location of the panel 2 has been fixed relative to the footing 41, any irregularities having been suitably filled by grouting 41*a*.

The tops of adjacent panels 2 are supportingly interconnected by nailing a plate member 42 (FIGS. 12, 13) onto the headers 34 of adjacent panels 2.

By staggering the plate 42 sections in an overlapping relation to the headers 34 of adjacent panels 2, ample rigidity is attained for the upper portions of the wall, and its attachment to the ceiling and/or roof components indicated at 43.

If the building does not have a slab floor as indicated in FIG. 12, but instead, as shown in FIGS. 14–16, is of a type having a horizontal floor joist 44 such as a type as used in a building having a basement or crawl space, the joist 44 extends outwardly into the void space 46 at the lower end 48 of the inner insulating block 10; and pieces of insulation block (not shown) are fitted, between joists 44, into the remaining portions of the void space 46.

Suitable wooden plates 50 and 52 (FIG. 14) are laid upon the top of the footing 41, plate 50 providing a nailing member for the joists 44. Plate 52 is interposed between the footing 41 and the panel 2.

As shown in FIG. 15, adjacent portions of two of the outer insulation blocks 8 are provided with notches 54 for accommodation of a bearing plate 56 of the support rod 58 which extends upwardly from the footing wall 41 on which the panels 2 are supported.

The bolt 58, its lower portion 60 embedded in the footing 41, extends upwardly between adjacent panels 2, and more particularly between adjacent panel ribs 16 and panel blocks 8 of adjacent panels 2, they being slightly spaced as shown in FIG. 15; and thus no notching other than at 54 need be provided. A nut 61 for bolt 58 bears on bearing plate 56.

As shown in FIGS. 16 and 17, extra strength is provided for buildings in tornado or earthquake areas by providing an extension of the bolt 58; and, as shown, this is by a turnbuckle 62 secured to the top of bolt 58 and threadedly receiving a vertical rod 64 which extends to above the upper concrete flange or rib 12. A washer 66 and nut 68 bear down upon the rib 12, providing the extra strength of steel in tension extending from the level of the building's ceiling or roof to the building's footings 41.

Formation details for the panels 2 are now described.

A design form 70 is shown in FIG. 18. It is a wooden form assembly used as a mold for forming the composite panels 2 of this invention; and as shown the form 70 is made of spaced slats 72 of grainy wood, held by support strips 74 in parallel but spaced arrangement, with spaces 76 between the slats for providing eventually the vertical ribs 78 of the rubber mold form 80 yet to be described (FIGS. 24, 25).

Backing strips (FIGS. 18–20 or sheeting 82 are held between the design strips 72 and the supports 74 to confine the liquid rubber 84 (FIG. 23) in forming the rubber mold 80, when the form 70 has been placed in a rectangular form or border 86, desirably after a sandblasting step (FIG. 19) used for enhancing the wood-grain pattern in the design strips 70.

In forming the rubber mold 80 (FIG. 23), the liquid is obtained as a two-part rubber mixture from supply tanks poured into the form assembly of form 70 and frame 86; and the underside of the rubber form 80 being made has imparted to it the wood-grain design of the design strips 72 of the form 70, with spaced parallel ribs 78.

The rubber form 80 is removed from the form assembly of 70, 86, after it sets up or hardens sufficiently; and (FIG. 25) the rubber form 80 is then placed in another border frame 39*a* for pouring of the concrete panel 2, the rubber form 80 being of course inverted to provide that its wood-grain design and the ribs 78 are on its upper-face 90. The rubber mold face 90 is flushed with water (FIG. 25) to wet the mold surface 90, minimizing air bubbles on the exposed face 6 of the concrete panel 2 being then made.

FIGS. 27–40 illustrate steps of forming the panel 2 from the form shown in FIGS. 25 and 26, as now described more fully. The form 70 may be used repeatedly.

After the header 34 has been positioned along an edge of the assembly 80, 39*a*, as already mentioned, and the layer 6 of concrete has been poured thereinto as from pouring trough 92, and after the concrete is vibrated, but while the concrete of layer 6 is still wet, the insulation blocks 8 are laid (FIG. 30) on the concrete layer 6.

Then reinforcement bar supports 94, as shown in the form of M-shaped members, and supporting thereon the grid 21*b* of reinforcement bars 22–24–26 and anchor loops 36, are laid upon the concrete layer 6, the supports 94 being pushed downwardly (FIG. 32) into the layer 6 for solid support on the face 90 of the rubber mold 80. Plastic caps 96 (FIGS. 32, 33) on the lower ends of the supports 94 prevent rust spots from supports 94 from showing on the exterior surface (the lower surface in FIG. 32) of the panel layer 6 when the panels 2 are eventually finished and used.

Also while the concrete of layer 6 is still wet, concrete is poured into the void space 97 between and at the end of the pattern of the blocks 8 (FIGS. 30–32, 34), thereby providing the horizontal and integral concrete ribs 12, 14, 16 and the vertical concrete ribs 17, and embedding therein the grid 21*b* of reinforcing bars 22, 24, 26. The concrete is thus added generally to the level of the upper face of the polystyrene blocks 8.

Then, as shown in FIGS. 36 and 37, the larger insulation block shown as polystyrene slab 10 is placed onto the upper surface of the concrete and polystyrene blocks 8. The block 10 has the pattern of openings 18 which have already been described as accommodating the nailer blocks 20; and the outer face 98 of the overlying slab 10 with nailer blocks 20 is the interior face of the composite panel 2 when it is installed into a building. Those nailer blocks 20 (FIG. 38) are shown as held in the concrete by nails 99 pre-driven into the underside of nailer blocks 20 only a partial amount, the heads of the nails 99 thus being firmly gripped by the concrete of ribs 12–14–16–17 as the case may be.

It will be noted that the pattern of openings 18 of slab 10 is such that the holes 18 are spaced so as to be in registry with one of those concrete ribs. Also, it will be noted (FIGS. 5, 38), depending on the thickness of the nailer blocks 20, that some extra portion 100 of concrete is added to the concrete rib, by dumping into the hole 18, to support each block 20 so that its outer surface 102 (numbered 120 in FIG. 5) is substantially flush with surface 98 of the large insulation block 10.

The concrete portion 100, being integrally joined to the ribs or flanges 12–14–16–17, provides ample retention of the insulation block 10 to the panel module 2 by sufficiently adhering to the walls of the openings 18; and the tightness of one or more of the nailer blocks 20 in the holes 18 also adds to that retention.

The process hereinabove set forth provides what may be called a "positive" of the panel 2 by the form 70, and a "negative" thereof by the molded component 80, as steps of the overall process or procedure; and although such is known in arts such as the making of sculptures, it is believed new in the art of panel modules for a building, especially in the procedure which provides that in combination with the other features herein detailed.

Accordingly, when installed into a building, the face 6 of the panels 2 provides the desired wood grain appearance of vertical siding boards 3, corresponding in grainy appearance to the mold boards or slats 72, and intervening vertical accent grooves 4, corresponding to the spaces 76 of positive mold 70 and to the ribs 78 of negative mold 80; and a series of such panel modules 2 thus provides the desired wood-siding appearance for the building.

It is thus seen that a concrete panel module according to the inventive concepts provides a desired and advantageous device and process, yielding the advantage of a concrete wall facing of a decorative nature, and with many features of advantageous connection to components of the building, and with several features of advantages in the construction procedure for the panel modules.

Accordingly, it will thus be seen from the foregoing description of the invention according to these illustrative embodiments, considered with the accompanying drawings, that the present invention provides new and useful concepts of a concrete panel module and a process for making such a module, yielding desired advantages and characteristics, and accomplishing the intended objects, including those hereinbefore pointed out and others which are inherent in the invention.

Modifications and variations may be effected without departing from the scope of the novel concepts of the invention; accordingly, the invention is not limited to the specific embodiments or form or arrangement of parts herein described or shown.

What is claimed:

1. A panel module for a building, the panel module having a concrete face panel and a backing of insulation, the insulation being provided by spaced bodies of insulation, ribs of concrete being provided in the spaces between the insulation bodies, reinforcing bars being provided in the spaces between the insulation bodies, and held by the concrete poured thereinto to provide said ribs;

in a combination in which at least one of the reinforcing bars carries a connector member for use in connecting the panel module associated components of the building to the floor of the building, the connector member being a loop-like hook having leg means extending in a direction such that the axis of the leg means is generally perpendicular to the axis of the reinforcing bar, and with a portion of the leg means formed to underlie the reinforcing bar on a side opposite the connector member, thus providing means by which the panel module may be anchored to the floor of the building and any force component exerted on the connector member in the direction of the axis of its leg means is transmitted compressively to the reinforcing bar, the connector member extending into the region of the edge of the building's concrete floor, thereby providing means for securely anchoring the panel module to the floor of the building.

2. A panel module for a building, the panel module having a concrete face panel, and the face panel carrying along its upper edge a nailable header for secure retention of the panel module to associated ceiling and/or roof components, there being provided connector means fastened to the header prior to the pouring of the concrete of the panel module's face panel, a portion of the connector means extending into the region into which the concrete is poured, thus providing that the hardening of the concrete in that region will cause the header to be firmly and permanently connected to the panel module as a panel-manufacturing step rather than a building-erection step, the panel module carrying along its lower edge a connection means for secure retention of the panel module to associated floor components of the building.

3. The invention as set forth in claim 2 in a combination in which the lower edge connection means comprises a hook member which retains the panel module to a floor slab after the concrete of the floor slab is poured operatively around said hook member, the concrete face panel having a reinforcing bar, and the hook member being a loop-like hook having leg means extending in a direction such that the axis of the leg means is generally perpendicular to the axis of the reinforcing bar, and with a portion of the leg means formed to underlie the reinforcing bar on a side opposite the connector member, thus providing means by which the panel module may be anchored to the floor of the building and any force component exerted on the connector member in the direction of the axis of its leg means is transmitted compressively to the reinforcing bar, the connector member extending into the region of the edge of the building's concrete floor, thereby providing means for securely anchoring the panel module to the floor of the building.

4. A panel module for a building, the panel module being formed of concrete, and including a reinforcing member means, of substantially higher tensile strength than concrete, extending from the associated footing of the building onto which said panel module is attached, to above the said panel module, the reinforcing member means comprising an elongated vertical reinforcing rod and a coupling member, the coupling member being secured to an associated bolt which is embedded into the footing which has been provided for the building, and the coupling member and the portion of the vertical reinforcing rod being provided with threaded connection means, thus providing that a relatively short footing bolt may be used as a component embedded in the building's footing and yet there may be attained the extra strength, such as protecting against tornado and/or earthquake conditions, of reinforcement extending from the footing to above the panel module, without the disadvantage of a rod of that relatively long length having been embedded in the building's footing prior to the time of installation of the panel module on to building footing.

5. The invention as set forth in claim 4, in a combination in which the said reinforcing member means is comprised of (a) a retainer member which has a lower portion thereof retained in the associated footing of the building, and has its upper end threaded for receiving an associated threaded coupling means, (b) a threaded coupling device, (c) a vertical rod member extending operatively to above the said panel module, the vertical rod member having its upper and lower ends threaded, the lower end threadedly engaging the coupling means, and (d) threaded means for threadedly engaging the upper end of the vertical rod member.

* * * * *